United States Patent [19]

Hearsh

[11] 4,366,636

[45] Jan. 4, 1983

[54] DOUBLE POCKET EASEL ENVELOPE

[75] Inventor: Tilford Hearsh, Kansas City, Mo.

[73] Assignee: Tension Envelope Corp., Kansas City, Mo.

[21] Appl. No.: 274,415

[22] Filed: Jun. 17, 1981

[51] Int. Cl.[3] ..... G09F 1/12

[52] U.S. Cl. ..... 40/159; 40/152.1

[58] Field of Search ..... 40/152, 152.1, 158, 40/159

[56] References Cited

U.S. PATENT DOCUMENTS

| | | | |
|---|---|---|---|
| 91,728 | 6/1869 | Eastman | 40/159 |
| 415,552 | 11/1889 | Orr | 40/152.1 |
| 828,984 | 8/1906 | Sweet | 40/152.1 |
| 1,284,051 | 11/1918 | Bowman | 40/159 |
| 1,347,269 | 7/1920 | Greble | 40/152.1 |
| 1,407,497 | 2/1922 | Sussman | 40/159 X |
| 1,486,652 | 3/1924 | Froelich | 40/158 X |
| 2,443,234 | 6/1948 | Ford | 40/152.1 |
| 2,453,902 | 11/1948 | Graham | 40/152.1 |
| 2,504,277 | 4/1950 | Otterson | 40/152.1 |
| 2,834,135 | 5/1958 | Clarke | 40/152.1 |
| 2,991,578 | 7/1961 | Messina | 40/152.1 |

*Primary Examiner*—Gene Mancene

*Assistant Examiner*—Wenceslao J. Contreras

*Attorney, Agent, or Firm*—Litman, Day & McMahon

[57] ABSTRACT

A double pocket easel envelope for displaying simultaneously two items includes two panel members foldable along a medial hinge line with each panel member having a top and bottom wall connected at envelope side edges and a common end edge to form a continuous envelope. A display window in each top wall permits viewing of the items. A brace extending between the panel members allows the envelope to freely stand on the side edges thereof. The brace includes respective tongues extending from each panel member back wall, and respectively having a pressure contact adhesive patch for mutual engagement. A seal flap provided with each panel member top wall includes pressure contact adhesive patch to selectively engage a coordinating adhesive patch on an associated bottom wall. The adhesive patches associated with one panel member are offset relative to the adhesive patches associated with the other panel member so that when the envelope is completely folded along the medial hinge line for dispersal with the seal flaps open, the respective panel member adhesive patches do not contact one another.

7 Claims, 7 Drawing Figures

Fig.6.
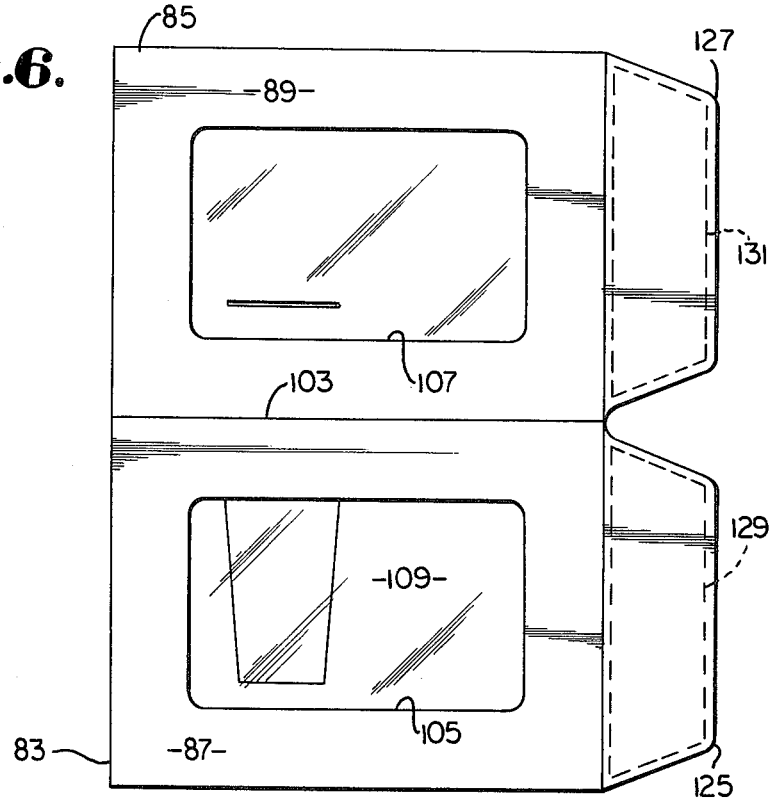
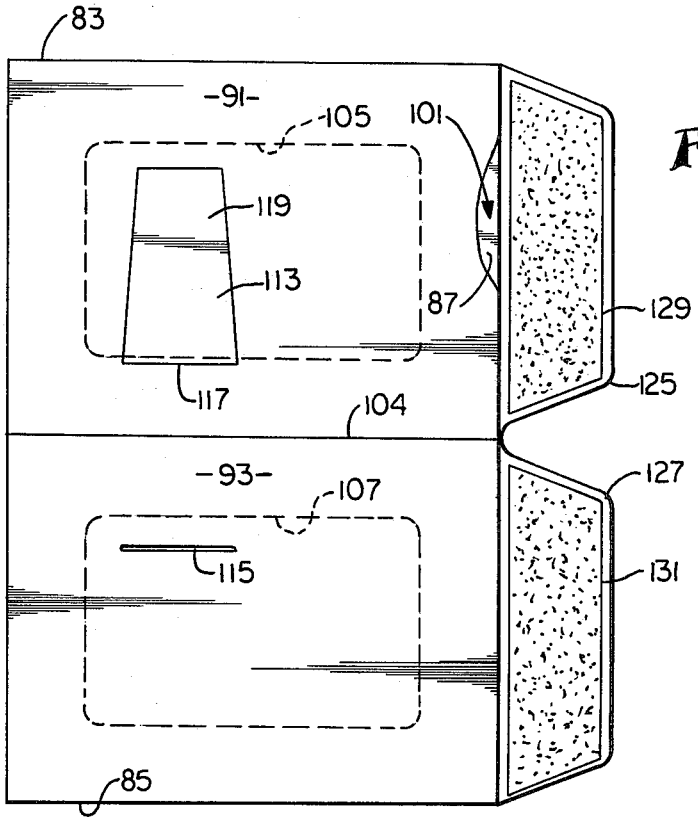
Fig.7.

DOUBLE POCKET EASEL ENVELOPE

BACKGROUND OF THE INVENTION

This invention pertains to display envelopes in general and, in particular, to a freestanding double pocket display envelope of the easel type for simultaneously displaying two photographs.

Devices which fold into an easel for displaying photographs or the like have been widely used in the past. Typically, such devices included a planar member for displaying an item and a suitable brace for positioning in an upright, freestanding relationship. Some devices employ two planar members with one having a display window and with the other used primarily for support. Further, such devices typically use a tongue and slit type brace to retain the two foldable members in a desired orientation. This type of brace is likely to slip, causing the easel to unfold and collapse. Moreover, devices that include an inner pocket with a seal flap are plagued with the seal flap prematurely sealing the pocket prior to the insertion therein of the item to be displayed, rendering the envelope unusable for display purposes.

OBJECTS OF THE INVENTION

Therefore, the objects of this invention are: to provide an easel envelope for simultaneously displaying two items; to provide such an envelope including two panel members foldable along a medial hinge line, each panel member having top walls for displaying a desired item; to provide such an envelope including a brace to retain the panel members in a partially folded orientation to allow the envelope to freely stand on the side edges thereof; to provide such a brace including coordinating, interengaging elongate tongues extending from each panel member bottom wall; to provide on such tongues a pressure contact adhesive for mutual adherence; to provide such an envelope including a top seal flap associated with each panel member which is extendable from the panel member top wall to the back wall to selectively seal each panel member; to provide such a seal flap which includes a contact pressure adhesive patch thereon mateable with a similar contact adhesive patch on an associated panel member back wall; to provide such panel member adhesive patches which are offset from one panel member relative to the other such that, upon folding of the envelope completely along the medial score line, as for dispersal with the seal flaps open, the associated adhesive patches do not engage one another; and to provide such an envelope which is simple in design, easy to manufacture, and particularly well adapted for its intended purpose.

Other objects and advantages of this invention will become apparent from the following description taken in connection with the accompanying drawings wherein are set forth by way of illustration and example, certain embodiments of this invention.

SUMMARY OF THE INVENTION

A double pocket easel envelope is provided for displaying two items simultaneously. The envelope includes two panel members which are foldable along a medial hinge line relative to each other. Each panel member has top and bottom walls which are connected at envelope side edges and at a common end edge to retain the respective top and bottom walls in an abutting relationship to define an envelope pocket therebetween.

Each top wall respectively contains a display window including a transparent window patch for viewing of an item. The bottom walls have a brace to retain the panel members at a desired degree of fold relative to each other, thereby allowing the envelope to freely stand on the envelope side edges. In one embodiment of the envelope the brace comprises tongues extending outwardly from each panel member rear wall and engageable together. Each tongue has a patch of pressure contact adhesive for mutual engagement. A seal flap on each panel member extends from the respective top wall and partially overlies a respective panel member bottom wall. Each seal flap has a patch of pressure contact adhesive which mates with a similar patch on the respective associated bottom wall to selectively seal each panel member. The adhesive patches associated with each panel member are offset such that when the panel members are folded relative to each other for dispersal with the seal flaps extending outwardly, the respective panel member adhesive patches do not contact one another and inadvertently seal.

The drawings constitute a part of this specification and include exemplary embodiments of the present invention and illustrate various objects and features thereof.

BRIEF DESCRIPTION OF THE DRAWINGS

FIG. 6 is a top plan view of the second embodiment of the display envelope in a flat, unfolded orientation.

FIG. 7 is a bottom plan view of the second embodiment of the display envelope in a flat, unfolded orientation.

DETAILED DESCRIPTION OF THE PREFERRED EMBODIMENT

Figure 1:
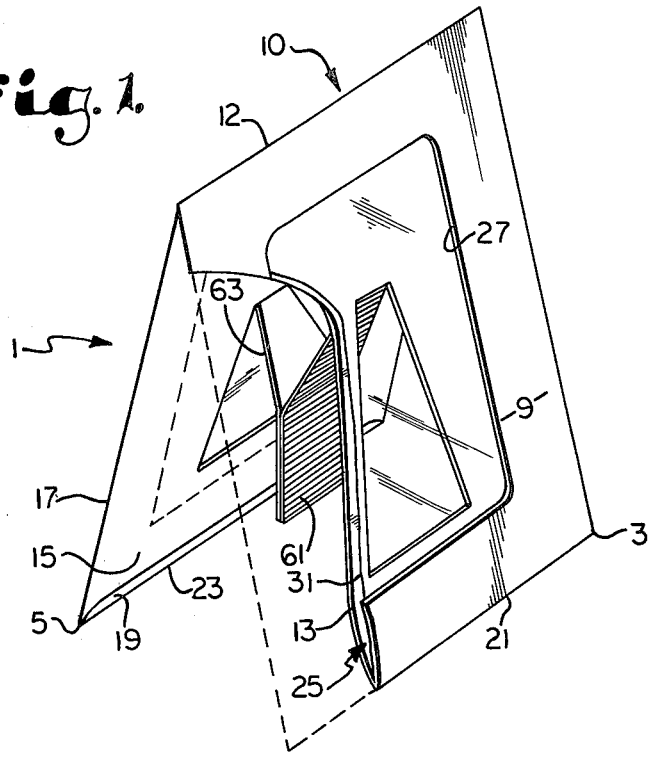
FIG. 1 is a perspective view of a double pocket easel envelope according to the present invention in freestanding display orientation with portions broken away to show details thereof.
Figure 2:
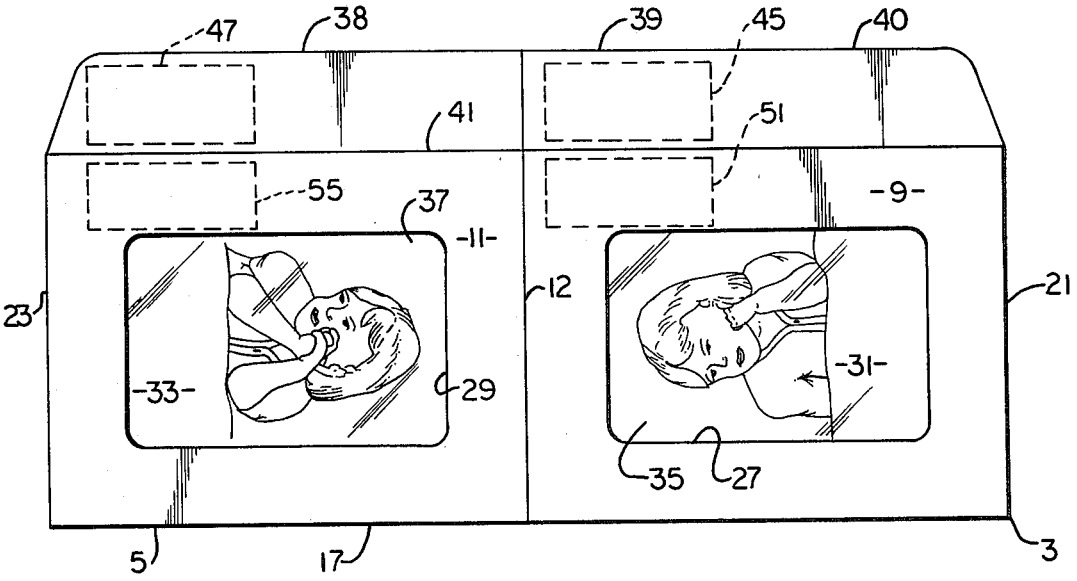
FIG. 2 is a top plan view of the envelope in a flat, unfolded orientation.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates a first embodiment of a double pocket easel envelope according to the present invention. As shown in FIGS. 1 through 4, the envelope 1 includes two panel members 3 and 5, each including a respective top wall 9 and 11 and a respective bottom wall 13 and 15. The panel members 3 and 5 are foldable about a medial hinge line 10 formed by parallel score lines 12 and 14, separating the respective top walls 9 and 11, and bottom walls 13 and 15.

The top wall members 9 and 11 are joined to the associated bottom wall members 13 and 15 at a common end edge 17. Further, the top wall members 9 and 11 are connected to the bottom wall members 13 and 15 at respective free side edges thereof by means of a side flap 19 or the like, forming envelope side edges 21 and 23 and providing an envelope inner cavity or pocket 25.

The respective top walls 9 and 11 of the panel members 3 and 5 have respective display windows 27 and 29 including respectively a transparent window patch 31 and 33. The display windows 27 and 29 allow various items such as photographs 35 and 37 to be viewed. In FIG. 1, the envelope 1 is shown freely standing without any items displayed therein for purposes of clarity.

A seal flap 39 selectively seals the envelope pocket 25 and, in the illustrated embodiment, the seal flap 39 has a portion 38 associated with the panel member 3 and a portion 40 associated with panel member 5 extending from the respective panel member top walls 9 and 11. In FIGS. 1–4 the seal flap 39 is single although it is within the present invention to provide a seal flap portion 38 separable from the seal flap portion 40 for individual selective sealing of the panel members 3 and 5.

Figure 3:
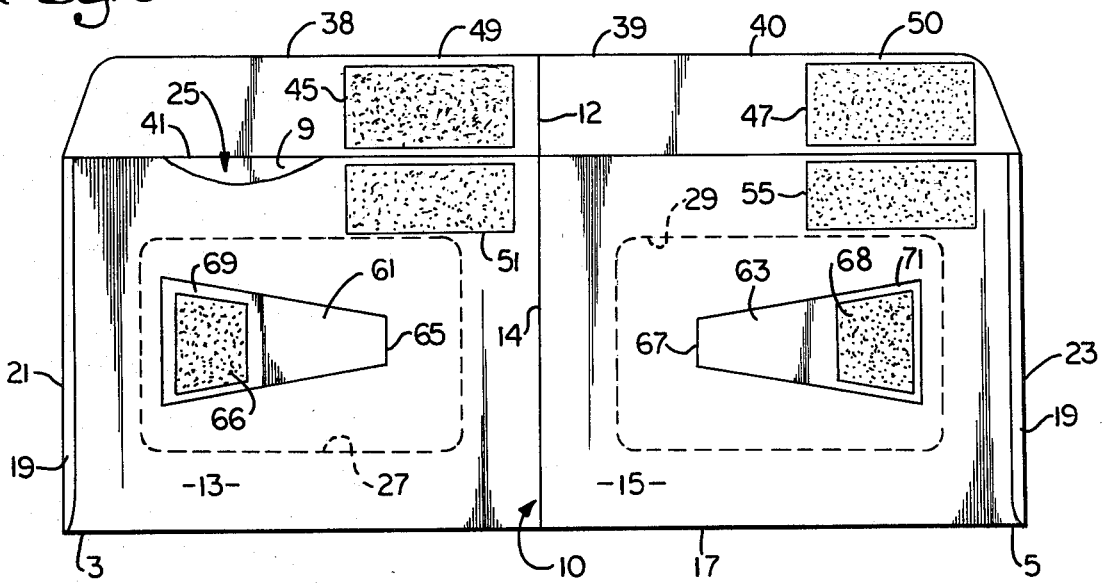
FIG. 3 is a bottom plan view of the envelope in an unfolded, flat orientation.

The seal flap 39 is foldable about a longitudinal fold line 41 to a position overlying a free edge portion of the panel member bottom walls 13 and 15 as shown in dotted lines in FIG. 3. A suitable adhesive is provided to selectively seal the seal flap 39. In the illustrated embodiment, patches of pressure contact adhesive are applied to portions of the seal flap 39 and portions of the respective bottom wall members 13 and 15.

Preferably, the pressure contact adhesive only adheres to a surface coated with a similar adhesive. When two items which have surfaces coated with such an adhesive are placed in interengaging relationship annd pressure is applied to urge the adhesive surfaces together, the items securely adhere together. Conversely, if an item having a surface coated with such an adhesive is urged against an item which is not similarly coated, the two items will not adhere. The adhesion is a result of the pressurized contact between the two surfaces and does not require a solvent such as water.

As shown in FIG. 3, the adhesive patches associated with the panel member 3 are offset relative to those associated with panel member 5. In the illustrated embodiment, the seal flap portion 38 includes a first adhesive patch 45 positioned on an inner portion 49 of panel member 3 near the top wall medial score line 12. A second adhesive patch 47 is positioned on seal flap portion 40 near an outer portion 50 of panel member 5. The first seal flap adhesive patch 45 mates with an associated adhesive patch 51 positioned on the bottom wall 13 near the bottom wall medial score line 14 such that when the seal flap 39 is folded about the fold line 41, the seal flap first adhesive patch 45 fully contacts the adhesive patch 51. The seal flap second adhesive patch 47 has an associated adhesive patch 55 positioned on bottom wall member 15 near an outer portion 50 of panel member 3. Likewise, when the seal flap 39 is folded along fold line 41, the adhesive patch 47 fully contacts adhesive patch 55.

Figure 4:
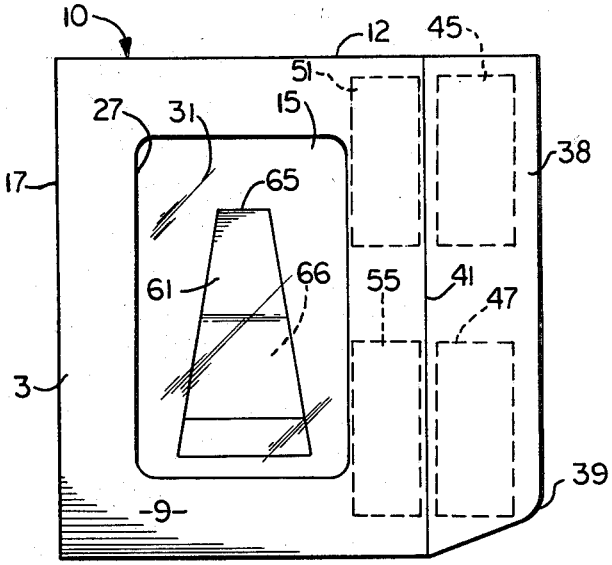
FIG. 4 is a top view of the envelope in a completely folded orientation as for dispersal.

The location of the adhesive patches 45, 47, 51 and 55 permit the envelope 1 to be folded completely about the bottom wall medial score line 14 such that bottom wall members 13 and 15 totally overlie each other with the seal flap 39 extending outwardly in an open position as shown in FIG. 4. In such a folded relation, adhesive patches 45 and 51 do not contact adhesive patches 47 and 55 respectively to cause the flap 39 to adhere. In the illustrated example, the adhesive patches are generally polygonal but it is understood that the patches could be of any suitable geometric configuration.

A brace means is provided to securely retain the two panel members 3 and 5 in a desired, partially folded relation for positioning the envelope 1 on the envelope side edges 21 and 23 in freestanding relationship, FIG. 1. In the illustrated embodiment, the brace means comprises two coordinating tongues 61 and 63 respectively extending from the bottom walls 13 and 15. The tongues 61 and 63 are preferably integral with the bottom walls 13 and 15 and are formed by making suitable scores or partial cuts through the bottom walls 13 and 15. The scores or partial cuts provide respective hinge line 65 and 67 for rotation of the tongues 61 and 63.

In the illustrated embodiment, a patch of pressure contact adhesive 66 and 68 respectively is applied to the free ends 69 and 71 of the tongues 61 and 63 such that when the free ends 69 and 71 are pressed into contact as shown in FIG. 1, the tongues 61 and 63 adhere together, thereby maintaining the two panel members 3 and 5 in a desired degree of fold for freestanding, upright positioning.

In use, the envelope 1 is designed to freely stand, FIG. 1 for displaying two desired items. For use, FIG. 2, desired items such as the photographs 35 and 37 are placed inside the envelope pocket 25. The seal flap 39 can be rotated about the fold line 41 wherein the seal flap adhesive patches 45 and 47 respectively contact the respective bottom wall adhesive patches 51 and 55. Upon applying pressure to the adhesive patches, the seal flap 39 bonds to the respective bottom walls 13 and 15. The tongues 61 and 63 are unfolded and, after folding the two envelope panel members 3 and 5 about the bottom wall medial score line 14, the two tongues 61 and 63 are secured together by pressing the respective tongue adhesive patches 66 and 68 together, thereby adhering the tongues 61 and 63 to one another. The envelope 1 is capable of freestanding upon the envelope side edges 21 and 23, FIG. 1, to display the desired items.

Multiple envelopes of the illustrated embodiment can be arranged, FIG. 4, folded for either dispersal to users or for storage. Because of the offset nature of the positioning of the adhesive patches associated with the respective panel members, when the envelope 1 is fully folded about the medial score line 14, the adhesive patches 45 and 51 associated with the panel member 3, do not engage the adhesive patches 47 and 55 associated with the panel members 5. Thus, the envelope 1 can be completely folded without any tendency for the seal flap 39 to inadvertently seal the envelope pocket 25 and render the envelope 1 unusable.

Figure 5:
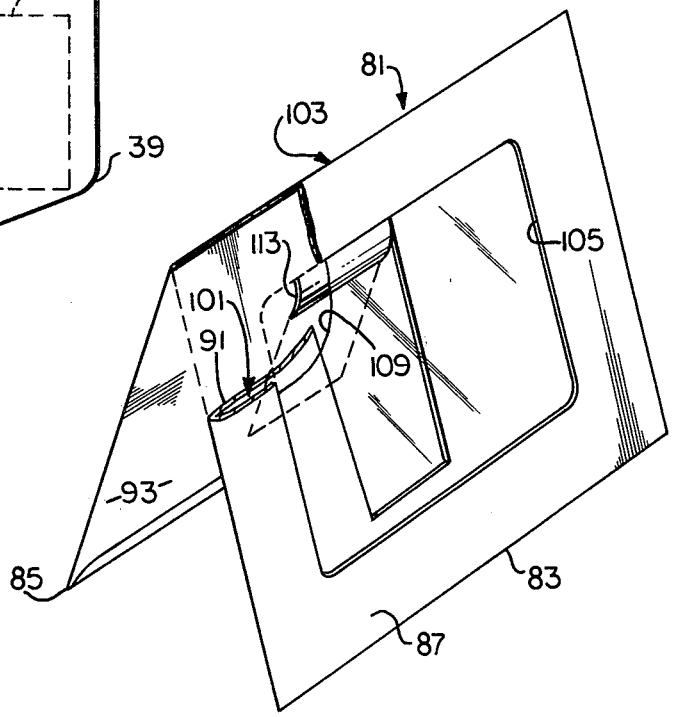
FIG. 5 is a perspective view of a second embodiment of a display easel envelope in freestanding display with portions broken away to show details thereof.

An alternate embodiment 81 of a double pocket easel envelope, FIGS. 5 through 7, includes two panel members 83 and 85 each having a respective top wall 87 and 89 and bottom walls 91 and 93, thereby defining a continuous pocket 101 therebetween. The two panel members 83 and 85 are foldable about a medial hinge line 102 formed by a score line 103 between panel member top walls 87 and 88, and a score line 104 between bottom walls 91 and 93, FIG. 5. Each panel member top wall 87 and 89 has a respective display window 105 and 107 with a respective transparent window patch 109 and 111.

A brace means extending between the envelope bottom walls 91 and 93 retains the envelope in a desired degree of fold, FIG. 5, for freestanding. In the illustrated embodiment, the brace means comprises a tab 113 formed in one of the bottom walls 91 and 93 and a slot 115 in the other bottom wall. The tab 113 is an elongate cut-out portion of the bottom wall 91 and is affixed thereto by a hinge line 117. A free end 119 of tab 113 is inserted into the slot 115 a short distance to retain the envelope 81 at a desired degree of fold and is captured therein preventing the envelope 81 from inadvertently unfolding.

A seal flap is provided comprising portions 125 and 127 which individually and selectively seals that portion of the pocket 101 associated with each panel member 83 and 85.

Items of various sizes and planar shapes may be displayed. Such items in the easel envelopes may be square or oblong. The envelope 1, FIGS. 1 and 2, accomodates an article for display with the article long axis extending upwardly when the envelope 1 is folded into an easel relationship. Conversely, the envelope 81, FIG. 5, accomodates an article for display with the article long axis extending horizontally when the envelope 81 is folded into an easel relationship. The window portions of either envelope 1 or 81 may be arranged to present the long axis of the article extending either upwardly or horizontally.

It is to be understood that while certain embodiments of the present invention have been illustrated and described herein, it is not to be limited to the specific forms or arrangements of parts described and shown.

What is claimed and desired to secure by Letters Patent is:

1. A display easel envelope for simultaneously displaying two pictures comprising:

(a) first and second panel members joined together and foldable relative to each other, said panel members each having respective top and bottom walls, said top and said bottom walls separated by a respective medial score line; said top wall medial score line and said bottom wall medial score line being colinear and forming an envelope medial hinge line about which said panel members are foldable; said respective panel member top and bottom walls all having free side edges and a free end edge; said respective panel member top and bottom walls connected at a common end edge providing a continuous envelope;

(b) said respective panel member top walls including a display window for viewing of articles received in said envelope;

(c) side flaps attached to free side edges of one of said top and bottom walls and overlying a portion of the other of said top and bottom walls forming envelope side edges; said side flaps including adhesive means to securely retain said top and bottom walls in abutting relation;

(d) a top seal flap including a portion thereof attached to respective first and second panel member top walls at said respective free edge thereof and selectively foldable against a portion of said respective panel member bottom walls about a fold line provided between said respective panel member seal flap portion and top wall free edge; said seal flap portions including adhesive means to secure said seal flaps against said respective bottom walls free edge; said seal flap portions foldable between a first position overlying an associated panel member bottom wall free edge and a second position wherein said respective seal flap portions are unfolded and are substantially co-planar with said associated panel member top wall;

(e) a brace means extending between said first and second panel members to selectively retain said panel members in mutually inclined relationship for freestanding display on said envelope side edges comprising:

(1) a tab having a free end and extending from said first panel member bottom wall;

(2) a slot positioned in said second panel member bottom wall; and wherein:

(3) said tab free end is lockingly insertable in said slot, thereby maintaining said panel members in inclined, spread apart relationship for freestanding, wherein (f) each of said panel members has an inner portion adjacent said envelope medial hinge line and an outer portion adjacent said respective envelope side edge, and (g) an adhesive patch applied respectively to the inner portion of the seal flap portion and the rear wall associated with one of said panel members and an adhesive patch is applied respectively to the outer portion of the seal flap portion and the rear wall associated with the other of said panel members; whereby said adhesive patches associated with each panel member seal flap and bottom wall are positioned in interengaging relationship equidistant from said respective seal flap fold line and said medial hinge line for mutual sealing engagement of said adhesive patches upon folding of said seal flap against said rear wall member and, are positioned such that when said panel members are folded about said medial hinge line with said seal flap portions extending outwardly into said second position thereof and with said respective panel member bottom walls overlying and abuttingly engaging one another, the adhesive patches associated with one of said panel members do not sealingly engage the adhesive patches associated with the other of said panel members.

2. A display easel envelope for simultaneously displaying two pictures comprising:

(a) first and second panel members joined together and foldable relative to each other, said panel members each having respective top and bottom walls, said top and said bottom walls separated by a respective medial score line; said top wall medial score line and said bottom wall medial score line overlying and forming an envelope medial hinge line about which said panel members are foldable; said respective panel member top and bottom walls all having free side edges and a free end edge; said respective panel member top and bottom walls connected at a common end edge providing a continuous envelope;

(b) said respective panel member top walls including a display window for viewing of articles received in said envelope;

(c) side flaps attached to free side edges of one of said top and bottom walls and overlying a portion of the other of said top and bottom walls forming envelope side edges; said side flaps including adhesive means to securely retain said top and bottom walls in abutting relation;

(d) a top seal flap including a portion thereof attached to respective first and second panel member top walls at said respective free edge thereof and selectively foldable against a portion of said respective panel member bottom walls about a fold line provided between said respective panel member seal flap portion and top wall free edge; said seal flap portions including adhesive means to secure said seal flaps against said respective bottom walls free edge; said seal flap portions foldable between a first position overlying an associated panel member bottom wall free edge and a second position wherein said respective seal flap portions are unfolded and are substantially co-planar with said associated panel member top wall;

(e) a brace means extending between said first and second panel members to selectively retain said panel members in mutually inclined relationship for freestanding display on said envelope side edges comprising:

(1) coordinating tab portions foldably connected to and extending from each of said respective first and second panel member bottom walls;

(2) each of said tab portions has free end portions with mutually engaging adhesive portion thereon whereby said tabs interengage in confronting relationship to retain said panel members in inclined, spaced apart relationship, wherein:

(f) each of said panel members has an inner portion adjacent said envelope medial hinge line and an outer portion adjacent said respective envelope side edge; and (g) an adhesive patch applied respectively to the inner portion of the seal flap portion and the rear wall associated with one of said panel members and an adhesive patch is applied respectively to the outer portion of the seal flap portion and the rear wall associated with the other of said panel members; whereby said adhesive patches associated with each panel member seal flap and bottom wall are positioned in interengaging relationship equidistant from said respective seal flap fold line and said medial hinge line for mutual sealing engagement of said adhesive patches upon folding of said seal flap against said rear wall member and, are positioned such that when said panel members are folded about said medial hinge line with said seal flap portions extending outwardly into said second position thereof and with said respective panel member bottom walls overlying and abuttingly engaging one another, the adhesive patches associated with one of said panel members do not sealingly engage the adhesive patches associated with the other of said panel members.

3. In a display easel envelope having first and second panel members having bottom walls and foldable about a common edge, said panel members adapted to retain articles therein for viewing, the improvement comprising:

(a) a brace means comprising coordinating tab portions foldably connected to and extending from each of said first and second panel member bottom walls; and wherein:

(b) each of said tab portions has a free end with a mutually engaging adhesive portion thereon whereby said tabs interengage in confronting relationship to retain said panel members in inclined relationship.

4. In an easel display envelope having first and second panel members each having top and bottom walls, said panel members foldable about a medial hinge line for folded storage, each of said panel members having a free side edge, each of said panel members including an opening, the improvement comprising:

(a) a seal flap assembly for selectively sealing said openings wherein:

(i) said seal flap includes portions provided with each of said panel members;

(ii) each of said seal flap portions is connected to said respective panel member top wall;

(iii) said seal flap portions are foldable about a fold line provided between said respective panel member seal flap portion and top wall;

(iv) said seal flap portions are foldable between a first position overlying an edge of an associated panel member bottom wall and a second position wherein said respective seal flap portions are unfolded and are substantially co-planar with said associated panel member top wall;

(v) each of said panel members has an inner portion adjacent said medial hinge line and an outer portion adjacent said side edge, and (vi) an adhesive patch is applied respectively to the inner portion of the seal flap portion and the rear wall of one of said panel members and an adhesive patch is applied respectively to the outer portion of the seal flap and the rear wall of the other of said panel members; whereby said adhesive patches associated with each panel member seal flap and bottom wall are positioned in interengaging relationship equidistant from a respective seal flap fold line and said medial hinge line for mutual sealing engagement of said adhesive patches upon folding of said seal flap against said rear wall member and, are positioned such that when said panel members are folded about said medial hinge line with said seal flap portions extending outwardly into said second position thereof and with said respective panel member bottom walls overlying and abuttingly engaging one another, the adhesive patches associated with one of said panel members do not sealingly engage the adhesive patches associated with the other of said panel members.

5. A display easel envelope comprising:

(a) first and second panel members joined together and foldable relative to each other, said panel members having respective top and bottom walls, said respective top and bottom walls separated by a medial score line; said top and bottom walls each having free side edges and a free end edge; said panel member top and bottom walls being connected at a common end edge and at respective free side edges forming side edges of the envelope and retaining said respective panel member top and bottom walls in abutting relationship, said top and bottom walls providing a continuous envelope having a pocket defined therein;

(b) one of said top walls including a display window for the viewing of articles received in said envelope;

(c) top seal flap means for selectively sealing said cavity; and (d) a brace means extending between said first and second panel members and selectively retaining said panel members in mutually inclined relationship for freestanding display of said articles, wherein:

(e) said brace means includes coordinating tab portions foldably connected to and extending from each of said respective first and second panel member bottom walls; and (f) each of said tab portions has free end portions with mutually engaging adhesive portions thereon whereby said tabs interengage in confronting relationship to retain said panel members in inclined, spaced apart relationship.

6. A display easel envelope for simultaneously displaying two pictures comprising:

(a) first and second panel members joined together and foldable relative to each other, said panel members each having respective top and bottom walls, said top and said bottom walls separated by a respective medial score line; said top and bottom walls all having free side edges and a free end edge; said respective panel member top and bottom walls connected at a common end edge providing a continuous envelope;

(b) said top walls respectively including a display window for viewing of articles received in said envelope;

(c) side flaps attached to free side edges of one of said top and bottom walls and overlying a portion of the other of said top and bottom walls forming envelope side edges; said side flaps including adhesive means to securely retain said top and bottom walls in abutting relation;

(d) top seal flaps foldably attached to said first and second panel member top walls and selectively foldable against a portion of said respective panel member bottom walls; said seal flaps including adhesive means to secure said seal flaps against said respective bottom walls, thereby closing and sealing said envelope, and (e) a brace means extending between said first and second panel members to selectively retain said panel members in mutually inclined relationship for freestanding display on said envelope side edges; wherein:

(f) said top wall medial score line and said bottom wall medial score line are colinear and form an envelope medial hinge line about which said panel members are foldable, (g) said brace means includes coordinating tab portions foldably connected to and extending from each of said respective first and second panel member bottom walls; and (h) each of said tab portions has free end portions with mutually engaging adhesive portion thereon whereby said tabs interengage in confronting relationship to retain said panel members in inclined, spaced apart relationship.

7. A display easel envelope for simultaneously displaying two pictures comprising:

(a) first and second panel members joined together and foldable relative to each other, said panel members each having respective top and bottom walls, said top and said bottom walls separated by a respective medial score line; said top and bottom walls all having free side edges and a free end edge; said respective panel member top and bottom walls connected at a common end edge providing a continuous envelope;

(b) said top walls respectively including a display window for viewing of articles received in said envelope;

(c) side flaps attached to free side edges of one of said top and bottom walls and overlying a portion of the other of said top and bottom walls forming envelope side edges; said side flaps including adhesive means to securely retain said top and bottom walls in abutting relation;

(d) top seal flaps foldably attached to said first and second panel member top walls and selectively foldable against a portion of said respective panel member bottom walls; said seal flaps including adhesive means to secure said seal flaps against said respective bottom walls, thereby closing and sealing said envelope, and (e) a brace means extending between said first and second panel members to selectively retain said panel members in mutually inclined relationship for freestanding display on said envelope side edges; wherein:

(f) said top wall medial score line and said bottom wall medial score line are colinear and form an envelope medial hinge line about which said panel members are foldable;

(g) said seal flap includes portions provided with each of said panel members;

(h) each of said seal flap portions is connected to said respective panel member top wall;

(i) said seal flap portions are foldable about a fold line provided between said respective panel member seal flap portion and top wall free edge; and (j) said seal flap portions are foldable between a first position overlying the free edge of an associated panel member bottom wall and a second position wherein said respective seal flap portions are unfolded and are substantially coplanar with said associated panel member top wall;

(k) each of said panel members has an inner portion adjacent said envelope medial hinge line and an outer portion adjacent said respective envelope side edge, and (l) an adhesive patch is applied respectively to the inner portion of the seal flap portion and the rear wall of one of said panel members and an adhesive patch is applied respectively to the outer portion of the seal flap and the rear wall of the other of said panel members; whereby said adhesive patches associated with each panel member seal flap and bottom wall are positioned in interengaging relationship equidistant from said respective seal flap fold line and said medial hinge line for mutual sealing engagement of said adhesive patches upon folding of said seal flap against said rear wall member and, are positioned such that when said panel members are folded about said medial hinge line with said seal flap portions extending outwardly into said second position thereof and with said respective panel member bottom walls overlying and abutingly engaging one another, the adhesive patches associated with one of said panel members do not sealingly engage the adhesive patches associated with the other of said panel members.

* * * * *